United States Patent [19]

Hanson

[11] 4,398,076

[45] Aug. 9, 1983

[54] PRODUCT RECOVERY METHOD AND SYSTEM FOR HYDROCARBON MATERIALS

[76] Inventor: Lester Hanson, 1903 Princeton Ave., Salt Lake City, Utah 84108

[21] Appl. No.: 241,229

[22] Filed: Mar. 6, 1981

[51] Int. Cl.[3] ..... H05B 6/78; C10G 1/02

[52] U.S. Cl. ..... 219/10.55 A; 219/10.55 B; 219/10.55 R; 201/16; 196/121; 196/134

[58] Field of Search ..... 219/10.55 A, 10.55 R, 219/10.55 B, 10.49 R, 10.57, 10.69, 10.71, 10.73; 196/98, 121, 134; 201/13, 14, 16, 19

[56] References Cited

U.S. PATENT DOCUMENTS

| | | | |
|---|---|---|---|
| 1,586,130 | 5/1926 | Trumble | 196/98 X |
| 1,925,028 | 8/1933 | Brieger | 219/10.57 X |
| 2,585,970 | 2/1952 | Shaw | 219/10.55 R |
| 2,700,644 | 1/1955 | Leffer | 201/16 X |
| 3,384,569 | 5/1968 | Peet | 201/16 X |
| 3,481,720 | 12/1969 | Bennett | 201/14 |
| 3,843,457 | 10/1974 | Grannen et al. . | |
| 3,926,415 | 12/1975 | Konas et al. | 219/10.73 X |
| 4,058,205 | 11/1977 | Reed, Jr. | 201/16 X |
| 4,065,361 | 12/1977 | Hanson | 219/10.55 A X |
| 4,237,359 | 12/1980 | Röth | 219/10.49 R X |

*Primary Examiner*—B. A. Reynolds
*Assistant Examiner*—Philip H. Leung
*Attorney, Agent, or Firm*—M. Ralph Shaffer

[57] ABSTRACT

A process and system for producing and utilizing to advantage vapors and gases from a hydrocarbon feedstock such as crushed oil shale, a coal and shale mixture, or straight coal. A prime mover driven by steam generated in the system produces electrical energy for supplying electrical power to the microwave oven employed. The prime mover is steam driven, such steam being supplied by a boiler. The boiler is, in turn, provided with a series of heat sources taking the form of the hot, spent shale, and/or coke from the coal, passing through such oven as well as perhaps portions of condensate or residue and portions or all of the gases generated in the system. The system thus reduces and in some cases may even eliminate power requirements otherwise imposed on an external electrical power source. Principally, however, the system generates sufficient energy as to be a major supplement to the energy requirement of an external power source. While magnetron tubes may preferably be employed in connection with the microwave oven used, other types of tubes or other electro-magnetic microwave generating means can be employed, this of a power requirement and wave length sufficient to heat the incoming feedstock. The feedstock itself is preheated by solids' heat exchangers, themselves raised in temperature by steam produced as well as the vapors and gases generated.

6 Claims, 1 Drawing Figure

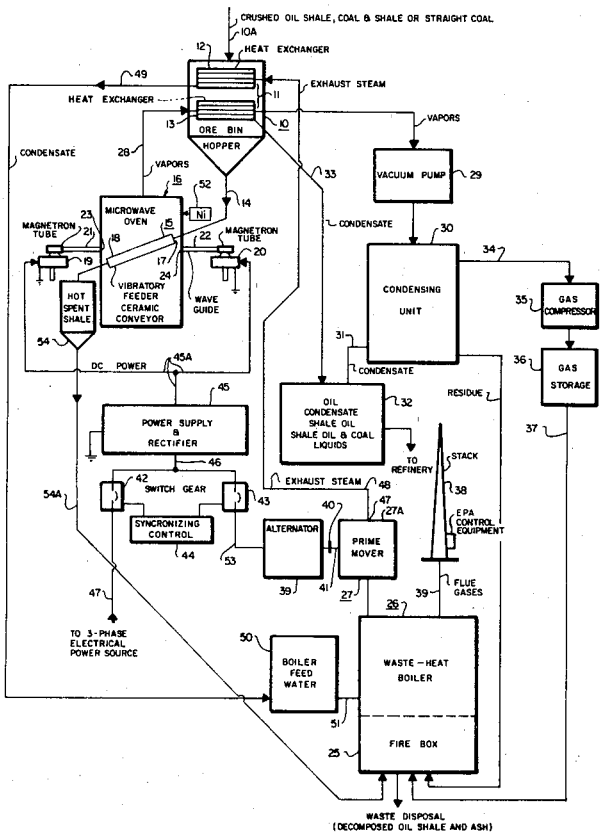

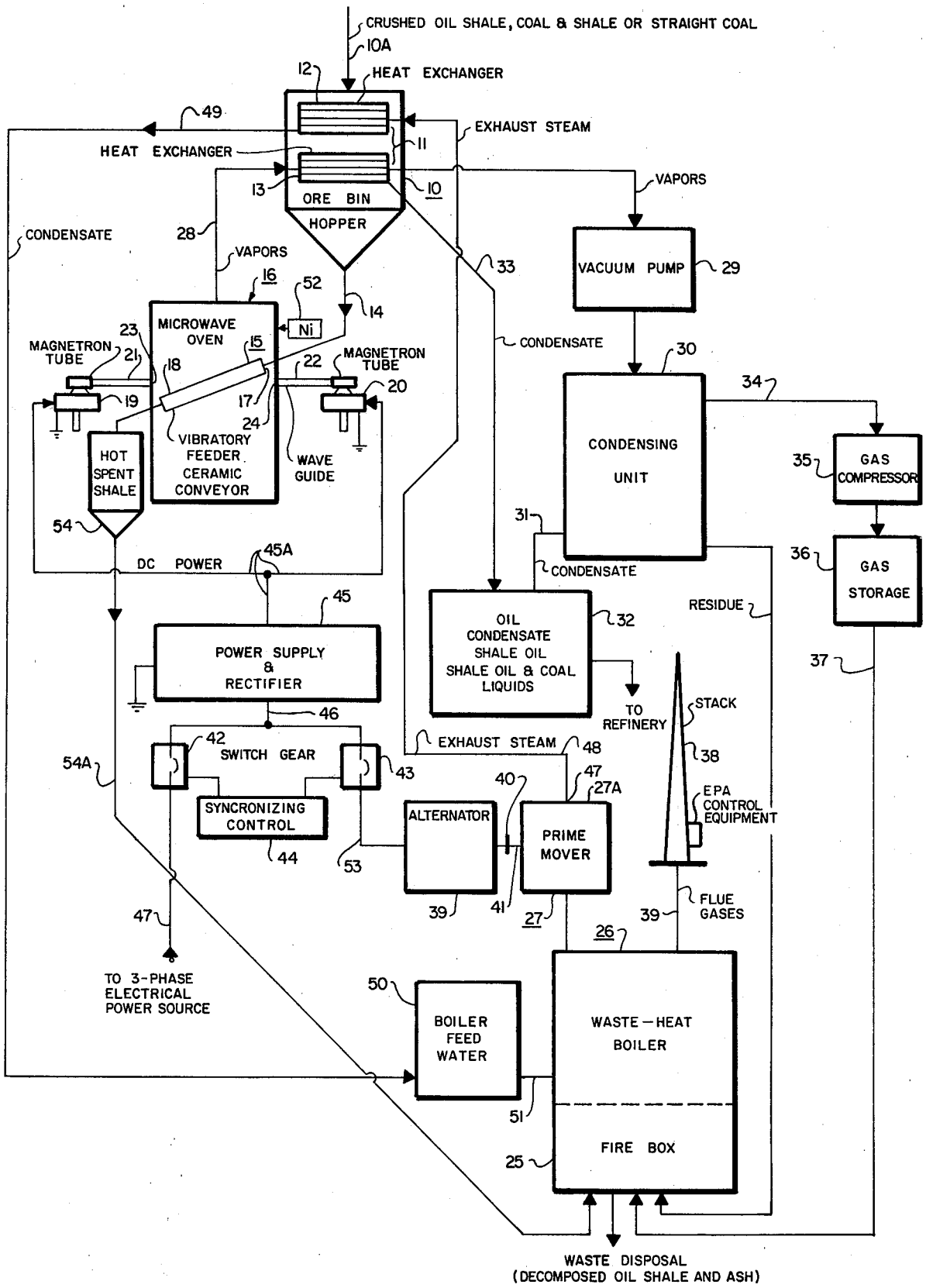
CRUSHED OIL SHALE, COAL & SHALE OR STRAIGHT COAL
10A
12
HEAT EXCHANGER
49
EXHAUST STEAM
HEAT EXCHANGER
11
13
10
ORE BIN
HOPPER
VAPORS
CONDENSATE
28
VAPORS
16
52
14
33
VACUUM PUMP
29
MICROWAVE OVEN
Ni
15
23
MAGNETRON TUBE
21
18
22
MAGNETRON TUBE
20
19
17
24
CONDENSATE
30
34
CONDENSING UNIT
HOT SPENT SHALE
VIBRATORY FEEDER CERAMIC CONVEYOR
WAVE GUIDE
35
GAS COMPRESSOR
54
31
36
GAS STORAGE
DC POWER
45A
CONDENSATE
45
RESIDUE
OIL CONDENSATE SHALE OIL SHALE OIL & COAL LIQUIDS
32
POWER SUPPLY & RECTIFIER
37
TO REFINERY
STACK
46
42
SWITCH GEAR
EXHAUST STEAM
48
38
54A
43
40
47
27A
EPA CONTROL EQUIPMENT
SYNCRONIZING CONTROL
ALTERNATOR
PRIME MOVER
44
53
39
41
27
39
FLUE GASES
47
26
TO 3-PHASE ELECTRICAL POWER SOURCE
50
BOILER FEED WATER
WASTE—HEAT BOILER
51
FIRE BOX
25
WASTE DISPOSAL (DECOMPOSED OIL SHALE AND ASH)

PRODUCT RECOVERY METHOD AND SYSTEM FOR HYDROCARBON MATERIALS

FIELD OF INVENTION

The present invention relates to processes & systems for subjecting hydrocarbon feedstock to electro-magnetic microwave energy for producing volatiles, vapors and gases therefrom, this to provide fuel or other products. A suitable oven is used and energy is supplied thereto for vaporizing the carbonacious materials contained in the feedstock as the same passes through the oven. The self-contained steam generating portion provides mechanical power for rotating a prime mover, thereby supplying a convenient source for generating electrical power. The prime mover drives an alternator to effect the desired power generation. Various portions of the output of the oven process are utilized to provide energy for the boiler operation.

DESCRIPTION OF PRIOR ART

The inventor's prior patents are relevant to the above system. See U.S. Pat Nos. 4,180,718, 4,065,361. Specific patents which are known and which deal with present subject area are as follows:

| | U.S. Pat. Nos. | |
|---|---|---|
| 773,139 | 3,110,652 | 3,644,194 |
| 1,548,307 | 3,177,333 | 3,652,447 |
| 1,957,347 | 3,179,239 | 3,660,268 |
| 2,090,873 | 3,261,959 | 3,665,141 |
| 2,343,337 | 3,330,405 | 3,836,743 |
| 2,597,345 | 3,374,553 | 3,843,457 |
| 2,542,028 | 3,377,266 | 3,974,354 |
| 2,573,906 | 3,449,213 | 4,003,774 |
| 2,809,154 | 3,503,865 | 4,065,361 |
| 2,825,677 | 3,547,803 | 4,180,718 |
| 2,903,407 | 3,560,347 | |
| | Foreign Patents | |
| 2843 | Netherlands | |
| 629,047 | Canada | |
| 473,865 | Canada | |

All of the above patents are relevant to the present invention in the general subject area of subjecting carbonacious materials to microwave energy for producing vapors and gases, and also for teaching various types of feeders used in connection with a microwave oven, for example. U.S. Pat. No. 4,180,718 also teaches the deriving of gases and feeding the same to a prime mover for driving the same and an alternator coupled thereto.

The present invention is believed unique in generating steam within the system for driving a prime mover and alternator combination, the steam portion of the system being supplied energy through feeding back to the firebox area thereof one or more of the following: hot, spent solids derived from the discharge end of the conveyor of the oven, condensate or solids derived from the condensing unit associated with vapor recovery, and combustible gases fed to the firebox from the gas recovery system associated with the oven. Otherwise, the energy would be wasted.

BRIEF DESCRIPTION OF THE PRESENT INVENTION

In accordance with the present invention, a microwave oven incorporates a feeder conveyor having a feed end and a discharge end. The feed end is supplied with incoming feedstock by virtue of a hopper which has preheating heat exchangers. These heat exchangers preferably take the form of tubes which are separated for solid material flow, which tubes are heated by steam and exhaust gases of the system, by way of example. The microwave energy in the oven will vaporize and otherwise drive off carbonacious materials in the feedstock, the same producing vapors which are condensed and gases which are compressed and stored. The condensing unit employed offers both condensate and also residue, the latter being especially useful for feedstock for the steam generating boiler employed. Gases may likewise be subjected to combustion at the firebox area to add additional heat to the boiler. Hot, spent solids from the microwave oven offer their sensible heat to increase boiler water temperature and, as well, may be subjected to combustion either as carbonized shale or coke, by way of example. The prime mover utilized is hence steam driven, with exhaust steam therefrom being utilized in the preheating operation. The prime mover is thus coupled to an alternator for the purpose of generating appropriate electrical power for the power supply serving the magnetron tubes and thus the microwave oven.

OBJECTS

Accordingly, a principal object of the present invention is to provide a new method and process in connection with the processing of hydrocarbon solid materials for deriving liquifiable vapors and gases therefrom.

An additional object is to provide a self-contained system wherein steam is generated and employed to augment and perhaps even supplant external power requirements for a microwave oven, the latter being useful for processing crushed oil shale, coal and shale, or straight coal.

An additional object is to provide one or more internal sources of fuel and/or heated means whereby steam can be generated for aiding power requirements of a microwave oven system in a hydrocarbon processing plant.

BRIEF DESCRIPTION OF DRAWING

The features of the present invention which are believed to be novel are set forth with particularity in the appended claims. The present invention, both as to its organization and manner of operation, together with further objects and advantages thereof, may best be understood by reference to the following description, taken in connection with the accompanying drawing in which:

The sole FIGURE is a schematic diagram of the process and system of the present invention as relates to processing carbonacious materials such as crushed oil shale, a coal-and-shale mixture, or straight coal.

BRIEF DESCRIPTION OF PREFERRED EMBODIMENTS

In the sole Figure, ore bin hooper 10 receives incoming crushed oil shale, a coal-and-shale mixture, or straight coal at 10A. Hopper 10 is provided with a solids' heat exchanger system 11 preferably comprising two individual heat exchangers 12 and 13. These may be disposed in 90° relationship with respect to each other and may take the form shown in FIG. 2 of the inventor's prior U.S. Pat. No. 4,065,361. Thus, the entire structure shown in FIG. 2 of this patent may be incorporated as an integral portion of hopper 10 through which the solids descend as by path 14 leading to the conveyor 15 provided through microwave oven 16. Conveyor 15 is preferably of the vibratory type; preferably, the same will comprise a Syntron, ceramic-trough type conveyor. Usual apparatus is included for vibrating the conveyor in a customary fashion. Kindly note the contents of the inventor's above-referenced patent and see also another of the inventor's prior U.S. Pat. No. 4,180,718. The vibratory feeder conveyor, standing alone, is common in the art as well as means for vibrating such conveyor. In the present invention, the conveyor is sloped from its input end 17 to its discharge end 18, see the sole FIGURE. The microwave oven 16 itself may take any one of several forms; suffice it to say, electro-magnetic microwaves are introduced into the microwave oven for the purpose of substantially heating hydrocarbon contents of conveyor 15. For this purpose, magnetron tubes 19 and 20 may be provided, suitably cooled, and provided with appropriate wave guide means 21 and 22 leading to oven apertures 23 and 24. Hot, spent shale at 54 coming from the discharge end 18 of conveyor 15 is conducted via enclosed structure 54A to the firebox 25 of waste heat boiler 26. This serves a purpose for efficiency of operation, as will be explained hereinafter. It is sufficient to say for present purposes that the hot, spent shale, by its sensible heat, will provide energy for the boiler to vaporize water therein for producing steam to drive prime mover 27. Where either coal or coal plus oil shale are employed as the feedstock then a carbonizing takes place and also coke is produced in the oven, thus further providing for a fuel for the waste heat boiler 26. Even the oil shale standing alone, upon processing in oven 16, may produce surface-carbonized solid residue which itself may be subjected to combustion for producing additional heat at boiler 26.

Reverting now to oven 16, the purpose for the inclusion of the oven, of course, to drive off vaporized and volatile products from the feed stock entering into and passing through such oven. Vapors and gases thus proceed upwardly along line 28, i.e., through appropriate ductwork, into and through the heat exchanger 13 which may comprise a series of tubes. See again U.S. Pat. No. 4,065,361. The vapors and gases proceed through this lower heat exchanger to vacuum pump 29, which pumps the vapors and gases to a condensing unit 30. Condensate from the condensing unit 30 is fed by suitable conduit or tubing at 31 to storage at stage 32, from thence to be routed to a refinery or simply to refining or other appropriate equipment. Additional condensate at 33 may be formed while the vapors are being slightly cooled subsequent to passage through heat exchanger 13. Such condensate is routed by suitable conduit at 33 to the oil condensate stage 32 as well.

Remaining gases as are drawn from oven 16 pass through conduit 34 affixed to condensing unit 30, to gas compressor and gas storage stages 35 and 36. Gas storage tanks associated with gas compressors are, of course, common in many industries. When needed, the gases from gas storage stage 36 are routed through suitable conduit 37 to the firebox 25 of waste heat boiler 26, there to undergo combustion for producing heat for the boiler. All products of combustion at the firebox are routed as flue gases through an appropriate stack 38, via conduit 39, the stack being provided with suitable anti-pollution control equipment, otherwise presently known as EPA control equipment.

Again, the waste heat boiler produces steam that drives a suitable prime mover, such as a steam turbine generator, 27A; other equipment such as a steam engine may comprise the prime mover at 27. Other types of equipment may be used, which equipment is steam driven by virtue of the steam produced by boiler 26. Alternator 39 is coupled, by suitable coupling or otherwise at 40, to the output shaft 41 of prime mover 27. The alternator produces electrical current at chosed voltage and, indeed, will comprise a 3-phase electrical power source. Standard electrical switch gear, 42 and 43, with common synchronizing control 44 are standard in the power industry and are used for paralleling the electrical power sources, at desired times, to the input of power supply and rectifier stage 45. This is done via lead combination 46. The switch gear 42, of course, will be coupled by leads 47 to a standard 3-phase electrical power source. Accordingly, power from alternator 39 at lead 53 is used supplemental to or in addition to the power derived from the external power source coupled to leads 47.

Depending upon the throughput and the feedstock used, the electrical energy derived ultimately from waste heat boiler 26, may simply constitute a supplemental power source or possibly even be self-sufficient in supplying additional energy, once the basic system is brought into operation, for performing the necessary driving-off of vapors and volatiles from the feed stock in the oven to produce the products desired. Power supply 45 supplies via 45A direct current power to the magnetron tubes 20 and 21. Stages such as tubes 20 and 21 may be considered simply as sources, of whatever nature, of electro-magnetic microwaves introduced into oven 16 to drive off the vapors and volatiles from the feedstock passing through oven 16.

It should be noted at this juncture, that the magnetron tubes might conceivably be replaced by other types of tubes or other means suitable for providing the requisite microwave energy to the microwave oven, of sufficient power and wave length to perform the heating function within such even. Other types of tubes may be appropriate. Where magnetron microwave power tubes are employed, these with their properly associated wave guides leading to the oven, it will be understood that many, many tubes will be needed, from perhaps six to even 70 or more, depending upon throughput desired. Suffice it to say, in any event, that d.c. power is supplied to the magnetron tubes 20 and 21, in conventional fashion. These tubes, as is well known in the art, will be provided with suitable means for pre-heating and then cooling the tubes, and controlling their magnets.

Returning now to consideration of prime mover 27, exhaust steam at 47 therefrom will be conducted by conduit 48 to heat exchanger 12, again possibly comprising a series of tubes as per U.S. Pat. No. 4,065,361. Accordingly, it is seen that heat exchangers 12 and 13 comprise solids' heat exchangers for preheating incoming ore leading to the input end 17 of the vibratory feeder conveyor 15.

The remaining steam and hot water follow the conduit route 49 for entry into boiler feed-water supply 50, such water being in a heated condition and being conducted by conduit 51 into the waste heat boiler 26.

In operation, the crushed oil shale, coal and shale or straight coal, or other carbonacious material is introduced into the hopper, is preheated by the spaced tubes at 12 and 13 of the two heat exchangers, and becomes heated feedstock for microwave oven 16. The same is transported at a controlled speed through the oven, by conveyor 15, whereby the magnetron tubes or other electrical, microwave energy sources are allowed to act upon the feedstock within the oven so as to drive off vapors, volatiles, and other gases from such feedstock. These vapors and gases serve to preheat the incoming material via heat exchanger 13 and in addition, provide condensate, and desired liquids and gases as per stages 30, 32, 35 and 36. The gases are returned to the system by being fed for combustion purposes to the firebox of boiler 26.

Three sources of heat and/or fuel are provided for the firebox 25: the hot, spent shale at 54, gases at 37, and condensate from condensing unit 30, these being fed to the firebox. Accordingly, additional sensible heat is provided, and this as well as materials suitable for combustion at the firebox for producing the steam required to drive the prime mover 27. Exhaust steam from the prime mover 27, when the same takes the form of steam turbine 27A, by way of example, is fed back to the hopper to pass through heat exchanger 12, further adding a heat source for the crushed feedstock at 10A. Steam, and the hot water formed at the heat exchanger 12, pass through conduit 49 to boiler feed water at 50 where the steam is condences and fed in the waste heat boiler via a conventional boiler feed pump, not shown.

The system is believed to be highly efficient in providing for not only self-contained preheating of the feedstock at the hopper, but also utilizing advantageously by-products of the system to effect such results. The liquid condensate from the feedstock, of course, is immediately available for refining, and the gases derived may likewise be separately processed or used as desired, in addition to a fraction thereof which is returned to the firebox of boiler 26 for combustion purposes.

Of course there are many other types of conveyors that can be used at 15. Whatever type of conveyor is employed, the same should be suitable for microwave operation.

If desired, a combustion-suppressant gas, such as nitrogen or carbon dioxide, for example, from supply 52 can be introduced into oven 16 so as to reduce intake air surges where present, lower oxygen presence within the oven, and thus contribute to safety and stability of operation at the oven point.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. Structure for processing feedstock materials comprised of at least one of the following, oil-shale and coal, for recovering, from a combustion-suppressant-gas-protected microwave oven, useful vaporized hydrocarbon materials and gases and for subjecting to combustion discharged solid materials of the so-processed feedstock coming from said oven, whereby to provide combustion energy to steam-driven means for providing electrical power to a load including said microwave oven, said structure including, in combination; a microwave oven having a throughput feeder and being provided with microwave energy generation means for heating incoming materials comprising said feedstock on said feeder, said feeder having an input end and also a discharge end for discharging heated spent solid materials of said feedstock as so-processed on said feeder in said oven, and said microwave energy generation means being constructed for coupling to an external, electrical power source; means for introducing a nonflammable gas into said oven, whereby to suppress combustion within said oven; first means coupled to said oven for receiving gases and vapors produced in said oven; second, condenser means for liquifying said vapors coupled to said first means; and third means receiving discharged heated solid materials coming from said feeder at said discharge and thereof and responsive to the fuel-character and sensible heat condition of said discharged heated solid material for firing the same and thereby steam-generating electrical energy at least a portion of which is coupled to said microwave energy generation means.

2. The combination of claim 1 wherein said third means includes a waste heat boiler, a prime mover coupled to said waste heat boiler, and an alternator coupled to said prime mover.

3. The structure of claim 1 wherein said third means comprises a steam turbine generator provided with a waste heat boiler responsive to materials of said third means.

4. The combination of claim 1 wherein said third means is also responsive to said vapors when processed for producing said electrical energy.

5. The combination of claim 4 wherein said third means is fed by said gases for increasing electrical energy output by said third means.

6. Apparatus for processing in a combustion-suppressant environment hydrocarbon-containing feedstock materials such as coal and/or oil shale, for producing hydrocarbon gases and vapors and also heated materials comprising a residual solid fuel for said apparatus, said apparatus including, in combination: an oven having a throughput feeder carrying said materials and being provided with oven-contents-heating microwave tubes constructed for coupling to a primary electrical power source, said feeder having an input end and also a discharge end for discharging said heated materials; means for introducing a nonflammable gas in said oven coupled thereto; first means coupled to said oven for receiving gases and vapors produced from said materials, when heated by said microwave tubes, in said oven; second, condenser means for liquifying said vapors; and third means receiving as fuel said heated materials from said conveyor at said discharge end thereof for producing steam-generated electrical power at least a portion of which comprises electrical energy for said microwave tubes.

* * * * *